US012044502B2

(12) United States Patent
Wood, Jr. et al.

(10) Patent No.: US 12,044,502 B2
(45) Date of Patent: Jul. 23, 2024

(54) FIREARM FOREGRIP HAVING AN INTEGRATED LIGHT

(71) Applicant: ELEVEN BRAVO TACTICAL, Charlottesville, VA (US)

(72) Inventors: Paul E Wood, Jr., Schuyler, VA (US); Laith Vincent, Charlottesville, VA (US); Larry Wood, Earlysville, VA (US)

(73) Assignee: Eleven Bravo Tactical, Charlottesville, VA (US)

( * ) Notice: Subject to any disclaimer, the term of this patent is extended or adjusted under 35 U.S.C. 154(b) by 0 days.

(21) Appl. No.: 17/933,556

(22) Filed: Sep. 20, 2022

(65) Prior Publication Data

US 2023/0266098 A1 Aug. 24, 2023

Related U.S. Application Data

(60) Provisional application No. 63/268,318, filed on Feb. 22, 2022.

(51) Int. Cl.
*F41C 23/16* (2006.01)
*F41G 1/35* (2006.01)

(52) U.S. Cl.
CPC ..... *F41C 23/16* (2013.01); *F41G 1/35* (2013.01)

(58) Field of Classification Search
CPC ..... F41C 23/16
USPC ..... 42/84
See application file for complete search history.

(56) References Cited

U.S. PATENT DOCUMENTS

| | | | | |
|---|---|---|---|---|
| 5,343,650 | A | 9/1994 | Swan | |
| 6,565,226 | B1 | 5/2003 | Cummings | |
| 7,584,569 | B2 | 9/2009 | Kallio et al. | |
| 7,954,273 | B1 | 6/2011 | Swan | |
| 9,488,437 | B1 | 11/2016 | Schnog | |
| 9,846,007 | B2 * | 12/2017 | Young | F41J 5/10 |
| 9,851,083 | B2 * | 12/2017 | Pinilla | F41C 23/22 |
| 2014/0000145 | A1 | 1/2014 | Merritt et al. | |
| 2015/0247700 | A1 * | 9/2015 | Merlino | F41C 23/16 42/75.01 |
| 2016/0165192 | A1 | 6/2016 | Saatchi et al. | |
| 2017/0268842 | A1 | 9/2017 | Kennair, Jr. | |
| 2017/0321990 | A1 | 11/2017 | Taylor et al. | |
| 2017/0372445 | A1 | 12/2017 | Nielsen et al. | |
| 2018/0224230 | A1 | 8/2018 | Myers et al. | |
| 2019/0208092 | A1 | 7/2019 | Patton | |
| 2019/0339042 | A1 | 11/2019 | Gull | |

* cited by examiner

*Primary Examiner* — Reginald S Tillman, Jr.
(74) *Attorney, Agent, or Firm* — Vance Intellectual Property, PC

(57) ABSTRACT

The present invention relates to a firearm foregrip having a power supply and an integrated front module, comprising a light source.

22 Claims, 6 Drawing Sheets

FIREARM FOREGRIP HAVING AN INTEGRATED LIGHT

FIELD OF THE INVENTION

The present invention, in some aspects, relate to a firearm foregrip having a power supply and an integrated front module, comprising a light.

BACKGROUND OF THE INVENTION

Firearms, in particular long-guns, defined as a firearm that requires the use of both hands and that is braced against the shoulder when used, benefit from the use of accessories attached thereto. These accessories, e.g., for an AR15/M16 rifle, include foregrips, optical scopes, laser sights, lights, rangefinders, etc. The accessories are typically mounted on the upper or lower handrails of the foregrip. It can be difficult to modify a firearm with more than two accessories due to the limited space on the handrails and the limited line of sight for the firearm. Several inventions have been in attempt to solve this problem.

U.S. Pat. No. 7,954,273 describes a weapon light accessory platform that is an annual housing that attaches to the barrel just beyond the foregrip. The platform can host various accessories that are threaded onto it. A primary problem with this platform solution is that it attaches beyond the foregrip thereby adding weight that can unbalance the firearm.

U.S. Pat. No. 5,643,650 describes an extended rigid frame receiver sleeve that provides a longer than standard handrail. This sleeve puts more weight toward the front of the firearm and still suffers from the limitations of how many accessories can be usefully attached to a handrail.

US 2014/0000145 describes a lighting system that attaches to the lower handrail and can be moved along the horizontal axis of the barrel. This system appears to prevent the use of a foregrip (i.e., vertical grip) and appears to add unnecessary weight to the front of the firearm.

U.S. Pat. No. 6,565,526 describes a system to allow flashlights to be magazine-mounted. This system appears to prevent the use of a foregrip and requires the use of non-standard magazines.

In spite of the above attempts, long-gun users would still benefit from a lighting system that does not take up valuable handrail space (e.g., for sights or foregrips) and does not add substantial weight to the distal end of the firearm, thereby decreasing its balance and potentially decreasing its accuracy.

SUMMARY OF THE INVENTION

In another aspect, the present invention provides a novel foregrip for a long-gun, comprising: a cylindrical housing and a light integrated into the distal end thereof.

In another aspect, the present invention provides a novel foregrip for a long-gun, comprising: a cylindrical housing and at least one LED light integrated into the distal end thereof.

In another aspect, the present invention provides a novel foregrip for a long-gun, comprising: a cylindrical housing and at least one laser light integrated into the distal end thereof.

In another aspect, the present invention provides a novel foregrip for a long-gun, comprising: a cylindrical housing and at least one LED light and at least one laser light integrated into the distal end thereof.

These and other aspects, which will become apparent during the following detailed description, have been achieved by the inventor's discovery of the presently disclosed and claimed foregrips.

DETAILED DESCRIPTION OF THE INVENTION

Figure 1A:
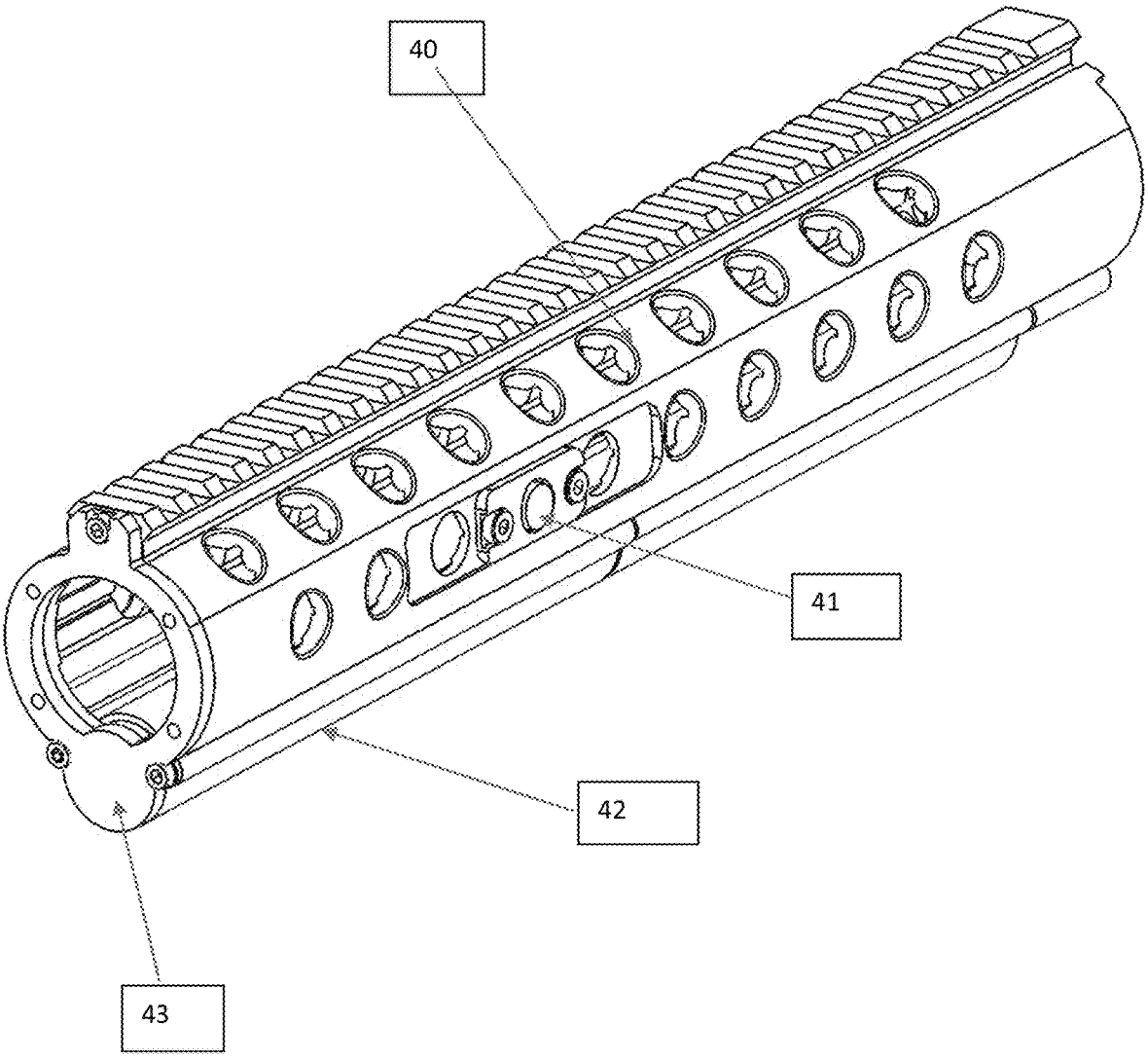
FIG. 1A shows a perspective view of an aspect of the foregrip.

The descriptions of the present invention have been simplified to illustrate elements that are relevant for a clear understanding of the present invention, while eliminating, for the purpose of clarity, many other elements found in typical long-guns. Those of ordinary skill in the art will recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art. Furthermore, the aspects identified herein are for exemplary purposes only, and are not meant to be exclusive or limited in their description of the present invention.

A long-gun as defined herein is a firearm that requires the use of both hands and that is braced against the shoulder when used. Long-guns are well known (e.g., AR15 and M16 rifles) and benefit from the use of accessories attached thereto (e.g., foregrips, optical scopes, laser sights, lights, rangefinders, etc.). Long-guns typically include a receiver, stock (e.g., butt stock) attached to the receiver, barrel attached to the receiver, a foregrip attached to the receiver, a magazine, and a forward sight (which is removable). Long-guns are also usually built to be disassembled into their constituent parts and then reassembled. This allows for the individual components of the long-guns (e.g., stocks and foregrips) to be replaced with modified components that can be designed for specific uses or as enhancements to the original manufacturer's design.

Foregrip refers to the grip for a user's forward hand. Sometimes a foregrip is also called a handguard or handgrip.

The following table provides a description of the numbered structures in the figures.

| # | Structure |
|---|---|
| 40 | Cylindrical Housing |
| 41 | Light Switch |
| 42 | Battery Compartment |
| 43 | Front Module |

-continued

| # | Structure |
|---|---|
| 51 | Switch Bus Bar |
| 52 | Battery |
| 61 | Bus Contact |
| 62 | Power Contact |
| 63 | Light Aperture |
| 64 | Openings (for mechanical mounting) |
| 65 | Lower Portion (of the front module) |
| 70 | Cylindrical Housing |
| 71 | Light Switch |
| 72 | Battery Compartment |
| 73 | Front Module |
| 74 | Battery |
| 75 | Upper Handrail |
| 80 | Exterior Portion (of the front module) |
| 81 | Light Source |
| 82 | Interior Portion (of the front module) |

In an aspect, the present invention provides a novel light-producing foregrip for use on a long-gun including at least a receiver and a stock and a barrel each attached to the receiver, the foregrip, comprising:

(a) a cylindrical housing (40,70) having a top portion, a bottom portion, a proximal end, a distal end, and a central aperture that is sized to receive the long-gun barrel, wherein the housing is configured to be mechanically fixed to the long-gun;

(b) an upper handrail (75) longitudinally connected to the top portion of the cylindrical housing;

(c) a battery compartment (42,72) formed into the bottom portion of the cylindrical housing (40,70)(e.g., located opposite to the upper handrail) and optionally configured to be externally accessible;

(d) a front module (43,73) integrated into the distal end of the cylindrical housing (40,70), the module comprising:

i a light source (81);

ii an electronic circuit configured to be in electrical contact with the light and battery compartment (42, 72); and, iii a light aperture (63);

(e) a light switch (41,71) in mechanical contact with the cylindrical housing and configured to activate the front module (43,73); and, (f) a switch bus bar (51) in mechanical contact with the light switch (41,71) and the front module (43,73).

The proximal end of the cylindrical housing is the end near the receiver or stock end of the long-gun. The distal end of the cylindrical housing is the end near the barrel opening (discharge end of the long-gun).

The top portion of the cylindrical housing corresponds to the top portion of the long-gun and is usually where the sight(s) is located. The bottom portion of the cylindrical housing corresponds to the bottom portion of the long-gun where the magazine and trigger are usually located and also where a vertical grip would be attached.

The central aperture of the cylindrical housing (40,70) defines an interior and exterior of the housing. The interior of the cylindrical housing (40,70) houses the portion of the barrel corresponding to the length of the housing. Being sized to receive the long-gun barrel, means that the barrel fits through the aperture. In another aspect, the aperture is larger in diameter than the barrel such that the cylindrical housing (40,70) substantially does not touch the barrel. In another aspect, the aperture is large enough to receive the barrel and is at least partially (or substantially) in contact with the length of the barrel enclosed by the cylindrical housing (40,70).

In another aspect, the proximal end (receiver end) of the cylindrical housing (40,70) is tapered (e.g., fluted) such that the circumference near the proximal end is narrower than the main body of the cylindrical housing (40,70).

In another aspect, the distal end (barrel end) of the cylindrical housing (40,70) is tapered (e.g., fluted) such that the circumference near the distal end is narrower than the main body of the cylindrical housing (40,70).

In another aspect, the cylindrical housing (40,70) is fixed to the long-gun through barrel and receiver lugs present on the long-gun. In this aspect, the cylindrical housing (40,70) is fixed to the long gun at two distinct points. Typically, the cylindrical housing (40,70) is fixed to the barrel and receive lugs via screws. Alternatively, the cylindrical housing (40, 70) is attached to the long-gun via a clamp (or clamps), bolt (or bolts), or a pressure mount (e.g., spring-loaded ring(s) that holds the housing in place).

Figure 4:
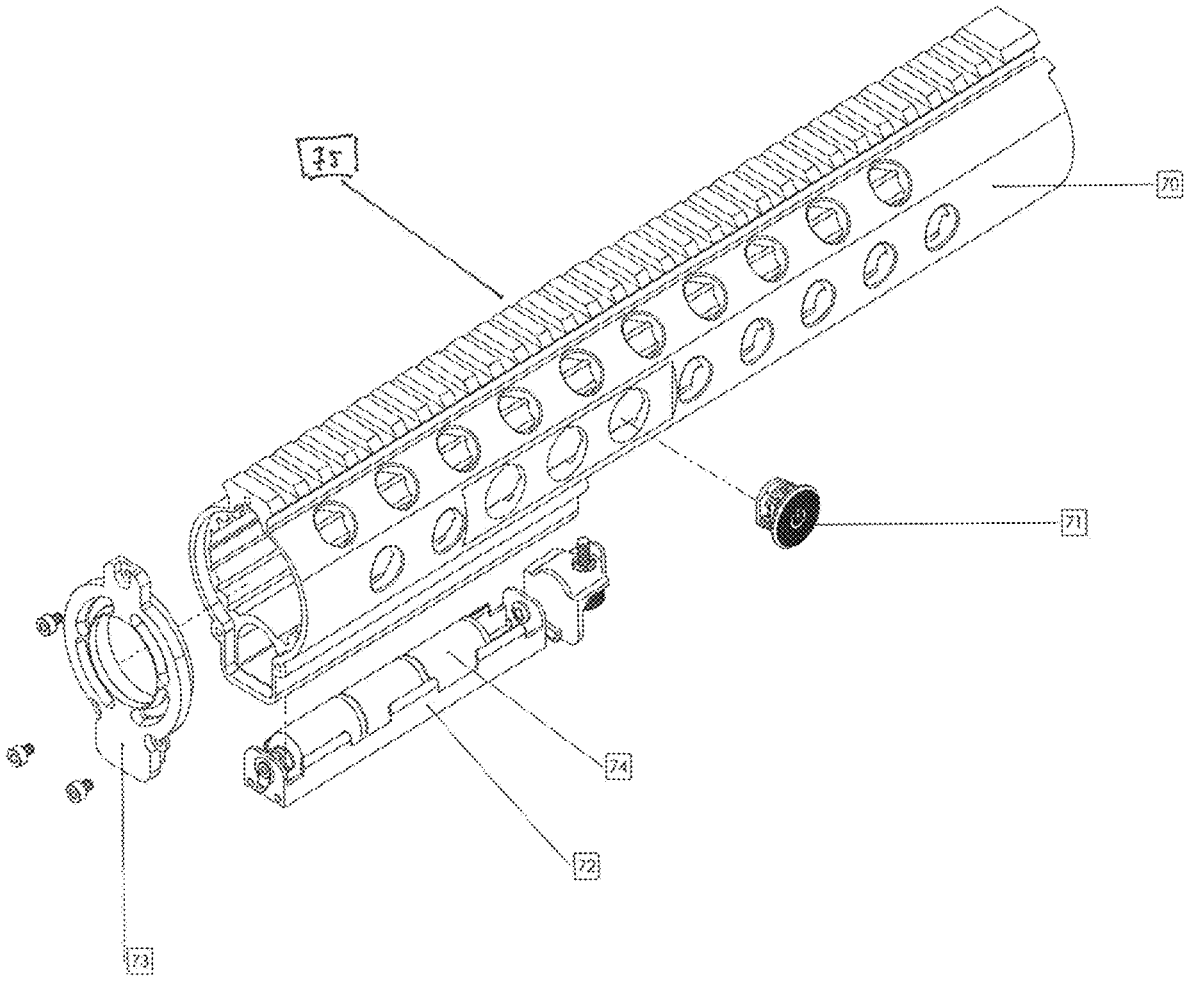
FIG. 4 shows a perspective view of an aspect of the foregrip.

In another aspect, the cylindrical housing (40,70) is configured with a plurality of openings to allow for heat dissipation from the gun barrel (see FIGS. 1A and 4). The perforations can be any suitable shape (e.g., square, triangular, and circular) and can be spaced any suitable way (e.g., symmetrically on the circumference and/or a plurality of linearly spaced perforations). Typically, the perforations are not located on the end portions of the cylindrical housing (40,70). The end portions of the cylindrical housing (40,70) are typically wherein the housing is attached to the receiver and barrel lugs of the long-gun and the ends can benefit from the absence of perforations.

In another aspect, the cylindrical housing (40,70) is configured to allow for a gas tube to pass through it (e.g., the long-gun being modified contains a gas tube).

The upper handrail being longitudinally connected means that it is connected to the length of the cylindrical housing (40,70) (e.g., in line with the barrel passing through the housing). In another aspect, the upper handrail is integrally formed into the cylindrical housing (40,70) (e.g., it is singular piece and/or it forms part of the housing)(see FIG. 1A). The upper handrail typically extends substantially the entire length of the cylindrical housing (40,70). In another aspect, when the cylindrical housing (40,70) is tapered on one end (e.g., the proximal end) or both ends, the upper handrail typically does not extend onto or over the tapered portion.

In another aspect, the cylindrical housing (40,70), further comprises: a lower handrail longitudinally connected to an exterior portion of the housing (not shown). In another aspect, the lower handrail is located on the opposite side of the cylindrical housing (40,70) from the upper handrail and is configured to receive long-gun attachments. In another aspect, the lower handrail is integrally formed into the cylindrical housing (40,70) (e.g., it is singular piece and/or it forms part of the housing). The lower handrail typically extends substantially the entire length of the cylindrical housing (40,70). In another aspect, when the cylindrical housing (40,70) is tapered on one end (e.g., the proximal end) or both ends, the lower handrail does not typically extend onto or over the tapered portion.

The upper handrail (and lower handrail if present) is configured to receive long-gun accessories (e.g., optical sights, laser sights, vertical grips, etc.).

Figure 1B:
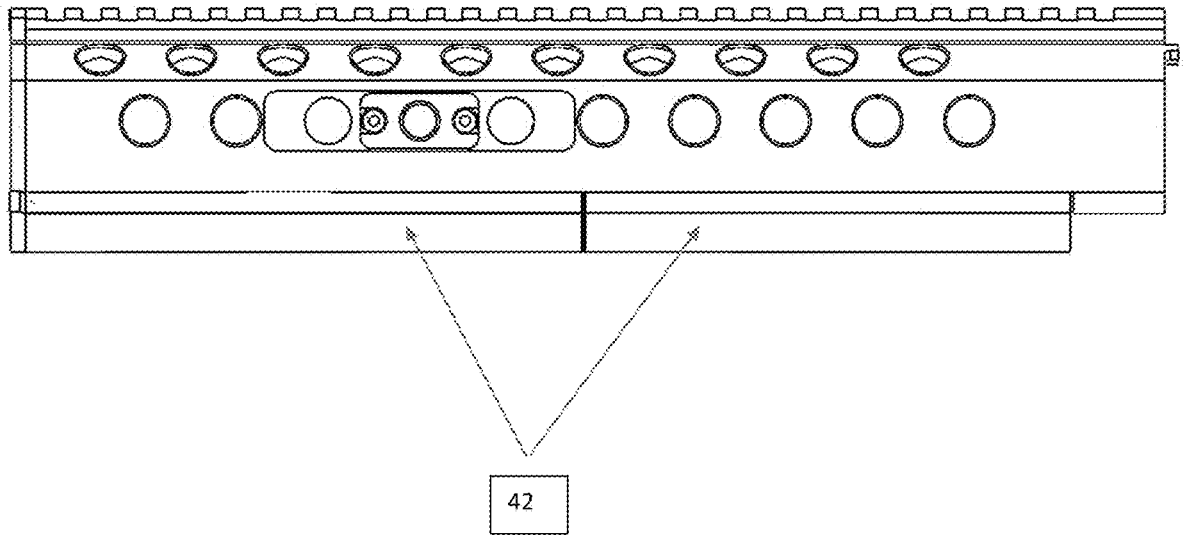
FIG. 1B shows a side view of an aspect of the foregrip.
Figure 2:
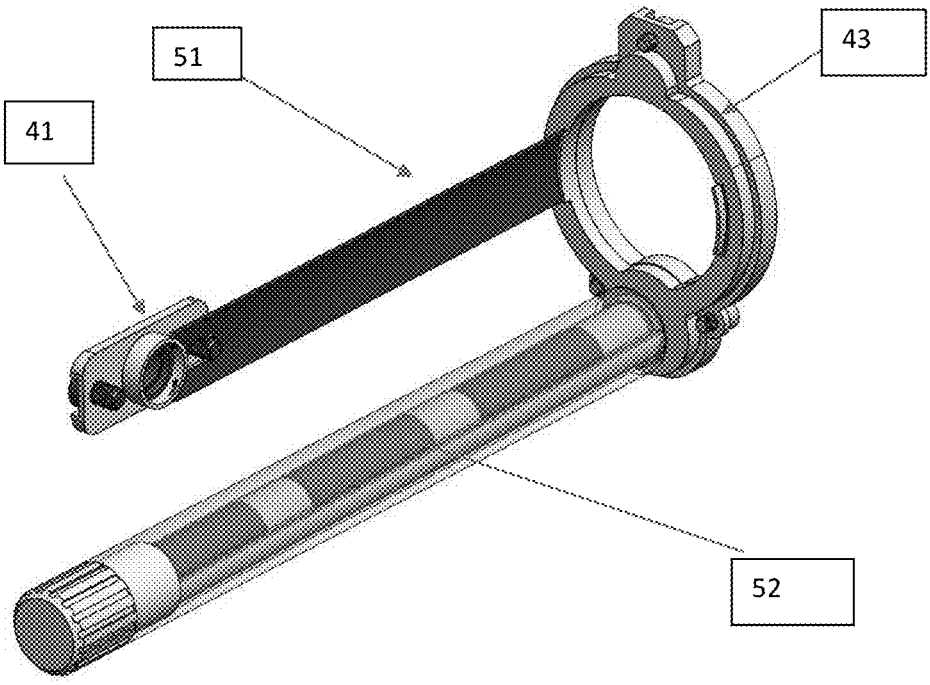
FIG. 2 shows a perspective view of an aspect of the power supply, front module, and switching mechanism.

In another aspect, the power supply is a battery (52,74) housed (e.g., see battery compartment 42 in FIG. 1B or 72 in FIG. 4) in the foregrip.

The battery compartment (42,72) being formed into the cylindrical housing (40,70) means that there is a chamber present in the cylindrical housing (40,70) sized sufficiently to house at least one battery (e.g., 52,74) capable of powering the devices (e.g., a power supply) housed in the front module (43,73) (see FIGS. 1-3A-B). The housing will typically be large enough to house a battery and framework designed to hold the battery (or batteries) in place.

In another aspect, the battery compartment, further comprises: a battery compartment door that encloses a battery (or batteries) in the compartment. Typically, the battery compartment door is mechanically fixed in a closed position to allow the long-gun to be transported and used. In another aspect, the battery compartment door is mechanically connected to the cylindrical housing via a latch and hinge (not shown). In another aspect, the hinge takes the form of a pin passing through the cylindrical housing and battery compartment door. Alternatively, the battery compartment door is held in place via pressure latches or another mechanical locking mechanism (e.g., latch, pin, clip, screw, button, etc.).

In another aspect, the battery compartment (42,72) is configured to twist or screw into the housing (40,70) or the front module (43,73).

In another aspect, the battery compartment (42,72) is configured to more permanently secured to the housing (e.g., via screws or bolts). In this configuration, the battery (or batteries) (52,74) is rechargeable either via a charging port (not shown) or via wireless charging.

In another aspect, the lower handrail is present and comprises: the battery compartment door. In another aspect, the lower handrail is the same length as the battery compartment door. In another aspect, the lower handrail is longer than the battery compartment door (e.g., it is two or three sections depending on the length of the lower handrail and the length of the battery compartment door).

The battery housed in the battery compartment (42,72) can be one or more batteries (e.g., two, three, or four batteries). The battery is chosen to provide sufficient power to the light(s) (and other devices if present)(e.g., a power supply). The battery(s) can be single use or rechargeable. As an example, two lithium 1.5V AA batteries can be used. As another example, three lithium 1.5 AAA batteries can be used. While it is beneficial for the battery compartment (42,72) to be configured to house standard batteries (e.g., AA or AAA), it can also be configured to house non-standard sized batteries. (e.g., a custom rechargeable battery or battery pack).

Figure 3A:
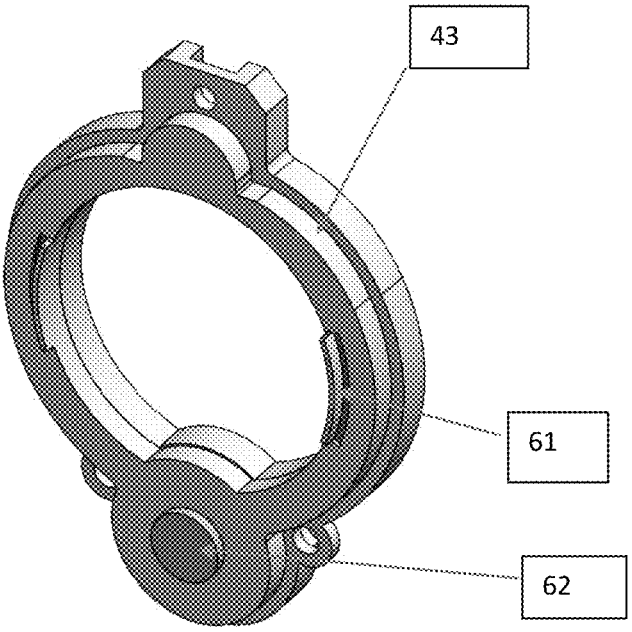
FIG. 3A shows a perspective view of an aspect of the front module.
Figure 3B:
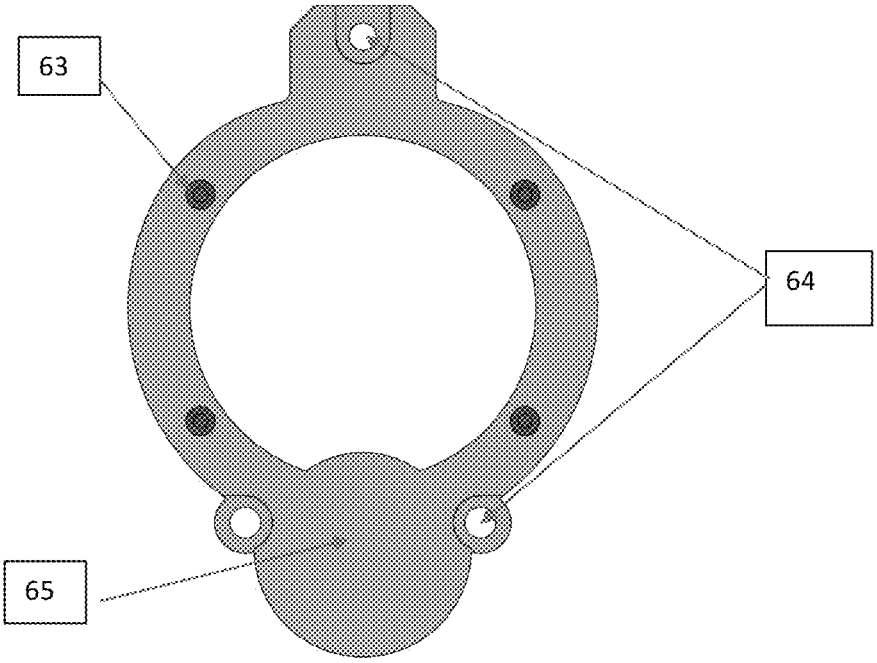
FIG. 3B shows a front view of an aspect of the front module

The front module (43,73) being integrated into the distal end of the cylindrical housing (40,70) means that the module is mechanically fixed (e.g., via a screw(s) or bolt(s)) to the cylindrical housing (40,70) (see FIGS. 1, 3A and 3B). The module is typically annular with an aperture at least as large as the barrel of the long-gun. The module can be mounted onto the distal end of the housing (e.g. has diameter similar to that of the cylindrical housing (40,70)). Alternatively, the module can be narrower in diameter than the cylindrical housing (40,70) and be inset in the cylindrical housing (40,70) (e.g., mounted on an inner ring located just inside the distal end of the cylindrical housing (40,70)).

In another aspect, the front module (43,73), comprises: at least one aperture for the light.

In another aspect, the front module (43,73), comprises: at least one light aperture (63)(also see aperture (shown in 80) and at least one light source (not shown in FIGS. 3A-B) that is configured to be in electrical contact with the battery compartment (42,72) (and battery when present) and the switch (41,71). Examples of the number of apertures include 1, 2, 3, 4 (see FIGS. 3B and 5), or more. In another aspect, the aperture(s), comprise: a lens, wherein the lens can be part of and/or configured to protect an LED (e.g., 81 in FIG. 5) and/or laser contained in the module.

In another aspect, the light source (or sources) fits into the light aperture (63)(or apertures)(e.g., an LED light inserted into 63). In another aspect, the light source is positioned behind light aperture(s) (63)(or the apertures shown FIGS. 4-5). In this aspect, the light(s) source(s) is configured to shine through the light aperture(s)(and optional len(s)).

Additional lights can be present. For example, in another aspect, the front module (43), comprises: a second light source that is configured to be in electrical contact with the battery compartment (42,72) (and battery when present). The second light source (and aperture) can be located near the first or at a distance therefrom (e.g., on the opposite side of the module). In another example, the front module (43,73), comprises: 2, 3, 4, 5, or 6 light sources. When a plurality of light sources is present, they are typically evenly spaced around the front module (43,73) (e.g., see FIG. 3B). Alternatively, some or all the light sources are located close together.

Figure 5:
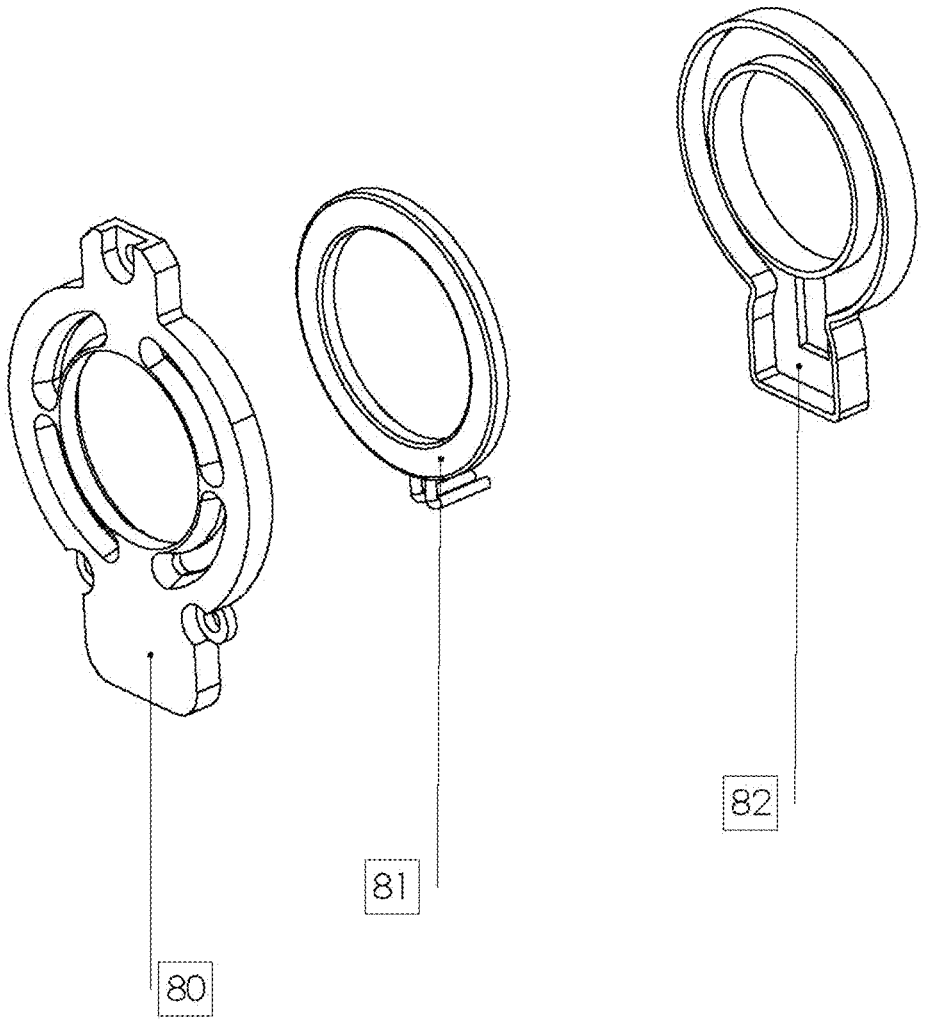
FIG. 5 shows an exploded view of an aspect of the front module

In another aspect, the front module (73), comprises an exterior portion (80) and an interior portion (82) that house a light source (81). In FIG. 5, the light is in the form of a ring LED. In another aspect, only one light source (81) is required to shine through multiple light apertures (and optional len(s)) in the exterior portion (80) of the front module (73)(see FIG. 5). In another aspect, multiple light sources can replace light source (81) and be housed in the interior and exterior portions (80,82)(e.g., a plurality of LEDs can replace the shown ring LED).

In another aspect, the front module (43,73), comprises: a power contact (62) that is in physical contact with the power supply (e.g., battery or batteries) (see FIG. 3A). In another aspect, interior portion (82), further comprises a power contact (not shown). The power contact (62) typically comprises a conductive metal and can be in any shape that can be in physical contact with the power supply (e.g., circular (see FIG. 3A), square, rectangular, etc.). In another aspect, the power contact (62) is configured to be in electrical connection with the light and other optional devices housed in the front module (43,73).

In another aspect, the front module (43,73), comprises: a bus contact (61) that is configured to be in physical contact with the switching bus bar (51)(see FIGS. 4 and 5A). In another aspect, the front module (43,73), comprises: a plurality of bus contacts (61) that are configured to be in physical contact with the switching bus bar (51)(see FIGS. 2 and 3A). This configuration allows for more than one switching bus bar (not shown).

In another aspect, the front module (43,73), comprises: a plurality of openings (64) for mechanically mounting (e.g., screw(s) or bolt(s)) the front module to the cylindrical housing (40,70).

In another aspect, the front module (43,73), comprises: a lower portion (65) that is optionally configured to house a camera (see FIG. 3B).

In another aspect, the front module (43,73), further comprises: a camera (not shown). The camera is typically in electrical contact with the power supply. In another aspect, the camera, further comprises a wireless communications transmitter and optionally a wireless communications receiver. In another aspect, being equipped with a wireless communications transmitter and optionally receiver, means that the camera, further comprises the transmitter and optional receiver and these devices are configured to allow the camera to transfer data to a receiver (e.g., a sub station configured to communicate with the foregrip). In some aspects, data transfer can operate via known protocols such as Bluetooth, Wi-Fi, and Zigbee. In some aspects, the camera and/or front module (43,73) can be configured with software that automatically initiates data transfer (e.g., once recording has started or stopped or once the foregrip is in contact with a substation).

In another aspect, the camera, further comprises a microphone.

In another aspect, the front module (43,73) is sealed (e.g., waterproof and/or impregnable to dust).

In another aspect, the front module (43,73) is removable such that it can be repaired, upgraded, and/or replaced with a module having a different configuration of lights, lasers, and/or camera(s)).

In another aspect, the light source is a light emitting diode (LED). In another aspect, the LED, comprises: an electronic board, comprising at least one LED, wherein the electronic board is in electrical contact with the battery compartment (42,72)(and battery when present). In another aspect, when a plurality of LED lights is present, a plurality of electronic boards is also present.

The output of the LED can vary depending on the needs of the use. Examples of the number of lumens produced by each LED (or the combination when a plurality is present) include 300, 400, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800, 2900, 3000, 3100, 3200, 3300, 3400, 3500, 3600, 3700, 3800, 3900, 4000, 4100, 4200, 4300, 4400, 4500, 4600, 4700, 4800, 4900 and 5000.

In another aspect, the light source is a laser. In another aspect, the laser, comprises: an electronic board, comprising at least one diode laser, wherein the electronic board is in electrical contact with the battery compartment (42,72) (and battery when present).

In another aspect, the light produced is white. In alternative aspects, one or more colors are produced (e.g., white, green, blue, and/or red).

In another aspect, the light produced is infrared (e.g., for "night vision").

In another aspect, a plurality of light sources are present (e.g., an LED source and an infrared source). Examples include 2, 3, or 4 different light sources. When more than one light source is present, the sources can be configured to operate off the same switch. Alternatively, a second (or more) switch (not shown) is present.

In another aspect, the foregrip, further comprises: a proximity detector (not shown). The proximity detector is configured to activate the camera and microphone (if present)(or other devices present) when the foregrip is moved a specified distance from a base (e.g., a car). This allows the camera and microphone (if present) to be automatically activated and begin recording once the foregrip is moved from its base. In another aspect, the proximity detector is in the front module. In another aspect, the proximity detector is configured to automatically initiate a transfer of any video and/or audio recordings when the foregrip is within a certain distance of its base (e.g., a substation configured to communicate with the foregrip).

The electronic circuit is configured electronically connect the light and battery when the light is activated via the light switch. The circuit is configured to operate the light. When additional devices are present (e.g., laser(s), camera, microphone, proximity detector), the same electronic circuit can be used to control these devices, or a second (or more) electronic circuit can be present to control the additional devices. In another aspect, the front module (43,73) houses the electronic circuit (or circuits if present).

In another aspect, the battery(s) present are sufficient to continuously power the light(s) for 0.5, 1, 1.5, 2, 2.5, to 3 hours. Typically, the light(s) are not used continuously for more than a few minutes at a time, which greatly extends the length of a battery. Since the system is designed for battery replacement. A user will typically be able to quickly replace a battery(s) in the field.

In another aspect, a light switch in mechanical contact means that is it in a fixed position relative to the cylindrical housing (40,70) and at least part of the switch passes through and into the housing to be configured to electrically connect the battery and front module (43,73). The switch is designed to activate the front module (43,73) (e.g., the light(s)). The type of switch used can vary. Examples include a toggle, a push button, and a momentary push button (only completes the circuit when being depressed).

In an example, the switch is pressurized to remain in the off position (e.g. a momentary push button switch). In this aspect, the light is only activated when the switch is pressed by a user.

In another aspect, the switch bus bar (51) connects the light switch (41,71) to the front module (43,73). This configuration allows for direct contact between the switch and module and avoids the needs for wires that may break over time.

In another aspect, a switch rail assembly is used in place of a switch bus bar (not shown). The switch rail assembly is designed to be in mechanical contact with the light switch and electrical contact with the light source (specifically the light(s) or at least the electronic circuit connected to the light(s)). This allows the light switch to complete the circuit when activated (e.g., depressed or toggled). In another aspect, the switch rail assembly is configured to allow the light switch to be moved forward or backward long the cylindrical housing. This adjustability allows a user to precisely configure the switch location.

In another aspect, the light switch is located on the side of the cylindrical housing (40,70). For example, the light switch can be located on the right or left side of the cylindrical housing (40,70). The switch bus bar (or rail assembly if present) is located on the same side of the cylindrical housing (40,70) as the light switch (e.g., right or left side).

One of the benefits of the present invention is that the length of the cylindrical housing (40,70) and switch bus bar (or rail assembly if present) can be changed based on the specifics of the long-gun being fitted, but the sizes of the remaining components remain the same.

Another benefit of the present invention is that integration of the light into the foregrip leaves more room for accessories on the long-gun.

Examples of long-guns with which the present invention can be used include the AR-15/M16 rifles. It is noted that the present foregrip is larger in diameter than a standard AR-15 foregrip. This is to allow for the inclusion of the battery and front module (43,73).

In another aspect, present foregrip, once installed on a long-gun is weather, water, pressure, and temperature resistant, which allows for typical day-to-day user environments as well as the tactical or operational user (e.g., law enforcement, military, security, etc.).

Numerous modifications and variations of the present invention are possible in light of the above teachings. It is therefore to be understood that within the scope of the appended claims, the invention may be practiced otherwise that as specifically described herein.

What is claimed:

1. A light producing handguard for use on a long-gun, the handguard, comprising:

(a) a cylindrical housing, comprising:

i a body, comprising:

a) a top portion;

b) a bottom portion, comprising: a battery compartment housed therein;

c) a first side portion, comprising: a light switch housed therein and configured to activate a front module;

d) a second side portion, opposite the first side portion;

e) a proximal end;

f) a distal end, comprising: a front module housed therein, the front module comprising:

i) a light source;

ii) an electronic circuit configured to be in electrical contact with the light and battery compartment;

iii) a light aperture;

iv) a camera, further comprising: a wireless communications transmitter;

v) a microphone; and, vi) a proximity detector configure to activate the camera and microphone; and, g) a switch bus bar housed in the body and in mechanical contact with the light switch and the front module; and, ii an interior portion, comprising:

a) a proximal end;

b) a distal end; and c) a central aperture between the proximal and distal ends, the aperture sized to receive a barrel of a long gun; and, (b) an upper handrail longitudinally connected to the top portion of the housing body;

wherein:

the handguard is configured to be mechanically fixed to the long-gun via barrel and receiver lugs present on the long-gun; and, the handguard is configured to be one-piece, self-contained unit that is swappable with a standard handguard.

2. The handguard of claim 1, wherein the proximal end of the cylindrical housing is tapered.

3. The handguard of claim 1, wherein the cylindrical housing is configured with a plurality of openings to allow for heat dissipation from the gun barrel.

4. The handguard of claim 1, wherein the cylindrical housing is configured to allow for a gas tube to pass through it.

5. The handguard of claim 1, wherein the cylindrical housing, further comprises:

a lower handrail longitudinally connected to the bottom portion of the cylindrical housing.

6. The handguard of claim 5, wherein the lower handrail, comprises: two sections.

7. The handguard of claim 1, wherein the battery compartment, further comprises:

a battery compartment door that is configured to enclose a battery in the compartment.

8. The handguard of claim 1, wherein the battery compartment is configured to twist or screw into the housing or the front module.

9. The handguard of claim 1, wherein the front module is mechanically fixed to distal end of the cylindrical housing.

10. The handguard of claim 1, wherein the front module is annular and configured with an aperture at least as large as the barrel of a long-gun.

11. The handguard of claim 1, wherein the front module, comprises: a plurality of light sources configured to be in electrical contact with the battery compartment.

12. The handguard of claim 1, wherein the light source is a light emitting diode (LED).

13. The handguard of claim 1, wherein the light switch is a toggle.

14. The handguard of claim 1, wherein the front module, further comprises:

iii an exterior portion; and, iv an interior portion;

wherein the exterior portion and interior portion house the light source.

15. The handguard of claim 14, wherein the light source is a light emitting diode (LED).

16. The handguard of claim 15, wherein the front module, further comprises: a plurality of light apertures.

17. The handguard of claim 1, wherein the camera, further comprises a receiver.

18. The handguard of claim 1, wherein the light switch is a push button.

19. The handguard of claim 1, wherein the light switch is a momentary push button switch.

20. The handguard of claim 1, wherein the battery compartment is configured to be externally accessible.

21. The handguard of claim 1, wherein the proximity detector is configured to activate the camera and microphone when the handguard is moved a specified distance from a base.

22. The handguard of claim 1, wherein the proximity detector is configured to automatically initiate a transfer of any video and/or audio recordings when the handguard is within a certain distance of a base.

* * * * *